US008517694B2

(12) United States Patent
Lee et al.

(10) Patent No.: US 8,517,694 B2
(45) Date of Patent: Aug. 27, 2013

(54) AIR COMPERSSOR SHROUD ASSEMBLY

(75) Inventors: Robert Lee, Jackson, TN (US); Gary D. White, Medina, TN (US); John Bezold, Jackson, TN (US); James Vintzel, Jackson, TN (US); Mark A. Etter, Humboldt, TN (US); Eric Bondhus, Big Lake, MN (US)

(73) Assignee: Black & Decker Inc., Newark, DE (US)

( * ) Notice: Subject to any disclaimer, the term of this patent is extended or adjusted under 35 U.S.C. 154(b) by 470 days.

(21) Appl. No.: 12/235,126

(22) Filed: Sep. 22, 2008

(65) Prior Publication Data

US 2009/0016902 A1 Jan. 15, 2009

Related U.S. Application Data

(63) Continuation of application No. 10/947,080, filed on Sep. 22, 2004, now abandoned.

(60) Provisional application No. 60/507,560, filed on Sep. 30, 2003, provisional application No. 60/504,788, filed on Sep. 22, 2003.

(51) Int. Cl.
*F04B 53/00* (2006.01)
*F04B 53/08* (2006.01)

(52) U.S. Cl.
USPC ..... 417/234; 417/313

(58) Field of Classification Search
USPC ..... 417/237, 313, 234, 435
See application file for complete search history.

(56) References Cited

U.S. PATENT DOCUMENTS

| | | | | |
|---|---|---|---|---|
| 4,536,130 | A * | 8/1985 | Orlando et al. | 417/63 |
| 5,187,953 | A * | 2/1993 | Mount | 62/195 |
| 5,532,435 | A * | 7/1996 | Bolton et al. | 174/135 |
| 6,406,270 | B1 * | 6/2002 | Kopel | 417/237 |
| 6,468,049 | B1 * | 10/2002 | Hung | 417/234 |
| 2002/0009372 | A1 * | 1/2002 | Gruber et al. | 417/234 |

* cited by examiner

*Primary Examiner* — Charles Freay
*Assistant Examiner* — Philip Stimpert
(74) *Attorney, Agent, or Firm* — Rhonda Barton; Adan Ayala

(57) ABSTRACT

The present invention generally relates to the field of air compressors and particularly to a shroud assembly for use with air compressors. An aspect of the present invention is directed to a shroud assembly having an outfit shroud, including a top outfit shroud coupled with a bottom outfit shroud; and, a pump shroud including a top pump shroud coupled with a bottom pump shroud; wherein the pump shroud at least partially encompasses a pump assembly of an air compressor and the outfit shroud at least partially encompasses the pump assembly, the pump shroud, a manifold assembly and a pressure switch assembly of an air compressor, the shroud assembly further configured for mounting to an air tank of an air compressor, the shroud assembly allowing for access to working parts of the air compressor and also allowing for a cooling air flow through the interior of the outfit shroud.

26 Claims, 12 Drawing Sheets

AIR COMPERSSOR SHROUD ASSEMBLY

CROSS-REFERENCE TO RELATED APPLICATIONS

This application is a continuation of U.S. patent application Ser. No. 10/947,080 entitled: Air Compressor Shroud Assembly filed Sep. 22, 2004 now abandoned, and claims priority under 35 U.S.C. §119(e) to U.S. Provisional Application No. 60/507,560 entitled: Air Compressor Shroud Assembly filed Sep. 30, 2003 and Provisional Application No. 60/504,788 entitled: Air Compressor Shroud Assembly filed Sep. 22, 2003 which are hereby incorporated by reference in their entirety.

FIELD OF THE INVENTION

The present invention generally relates to the field of air compressors and particularly to a shroud assembly for use with air compressors.

BACKGROUND OF THE INVENTION

The use of air compressors including a pump assembly, an air tank, a manifold assembly and a pressure switch assembly, wherein the pump assembly is contained within a casing is known in the art. However, a pump assembly of an air compressor may tend to overheat when contained within a casing due to inadequate air flow and ventilation.

Therefore, it would be advantageous to have a shroud assembly for use with an air compressor that provides ventilation and air flow through the interior of the shroud assembly which effectively assists in cooling the pump assembly and various other air compressor parts which may be contained therein.

SUMMARY OF THE INVENTION

Accordingly, an aspect of the present invention is directed to a shroud assembly comprising an outfit shroud, including a top outfit shroud coupled with a bottom outfit shroud and also, a pump shroud, including a top pump shroud coupled with a bottom pump shroud. The pump shroud at least partially encompasses a pump assembly of an air compressor and the outfit shroud at least partially encompasses the pump assembly, the pump shroud, a manifold assembly and a pressure switch assembly of an air compressor. The shroud assembly is further configured for mounting to an air tank of an air compressor, the shroud assembly allowing for access to working parts of the air compressor and also allowing for a cooling air flow through the interior of the outfit shroud.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 12B, exemplary embodiments of the present invention are shown.

An air compressor including an air tank coupled with a pump assembly, a manifold assembly, a pressure switch assembly, a handle assembly, and a shroud assembly, is shown in FIGS. 1 through 12B. In the current embodiment, the shroud assembly at least partially encompasses the pump assembly, manifold assembly, pressure switch assembly, and handle assembly.

The shroud assembly comprises an outfit shroud and a pump shroud. The outfit shroud includes a bottom outfit shroud and a top outfit shroud which couple together and provide the exterior appearance of the shroud assembly. The top and bottom outfit shrouds may couple via a variety of systems, for example an interlocking flange assembly, dovetail assembly, compression lock assembly, and the like. Further, a variety of fasteners may be employed, such as screws, bolts, pins, clips, and the like. The outfit shroud at least partially encompasses the pump shroud, the pump assembly, the manifold assembly, the pressure switch assembly and the handle assembly. The outfit shroud provides an aesthetically pleasing appearance designed to provide functionality, such as access to the working parts of the air compressor engaged by an operator and also, to provide air flow through the interior of the outfit shroud. It is understood that the configuration of the outfit shroud assembly may vary without departing from the scope and spirit of the present invention. For example, the length and width of the outfit shroud assembly may be varied to accommodate differently sized air tanks to which it may be coupled. The height of the outfit shroud assembly may also vary, for instance, the top outfit shroud may be made taller and/or the bottom outfit shroud may be made taller. The sizing of the outfit shroud assembly may vary between the top outfit shroud and the bottom outfit shroud while retaining the ability to couple both components together. Exemplary alternative embodiments of the outfit shroud assembly may be seen in FIGS. 12A and 12B. However, these exemplary embodiments provide examples and should not be read as limiting.

Figure 1:
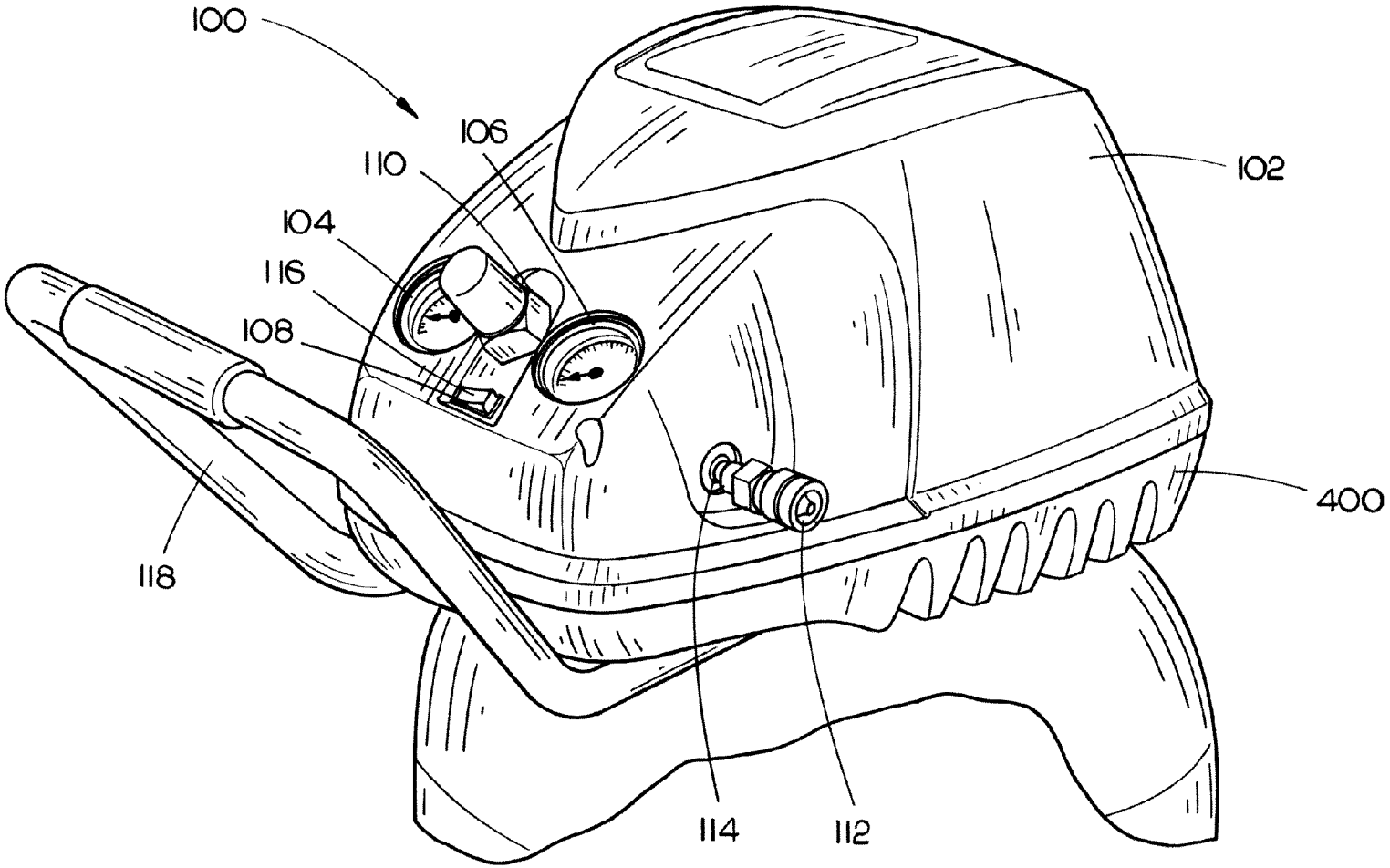
FIG. 1 is an illustration of an air compressor including a shroud assembly in accordance with an exemplary embodiment of the present invention.

In a preferred embodiment, illustrated in FIG. 1., an air compressor including a shroud assembly is shown. The top outfit shroud 102 of a shroud assembly 100 includes a first face which includes a plurality of functional features. For example, the first face includes a first gauge receiver 104 and a second gauge receiver 106. These receivers allow the operator to visually monitor the gauges through the top outfit shroud 102. The first face further includes a switch receiver 108 which provides the operator with access to a switch (described below) which controls operation of the air compressor. An adjustment knob receiver 110 is also disposed upon the first face. It is understood that the location of the first face upon the top outfit shroud may vary to accommodate various users and manufacturers of the present invention. Further, the number, location, and configuration of functional features disposed upon the first face may vary without departing from the scope and spirit of the present invention. It is contemplated that the first face may further include one or more indication areas. These indication areas may be contoured regions of the first face or regions of the first face proximal to the functional features. The indication areas may provide information in a variety of formats and may do so through the use of labels, adhesive materials, painted on information, engraved information, or other methods of manufacture as contemplated. The formats may include alphanumeric indication information, or other symbolic indication information as may be contemplated. Further, these indication areas may be used for product identification information, warning labels, warranty information, and the like.

On a first side of the top outfit shroud 102 an adapter assembly 112 extends through an adapter receiver 114. The adapter receiver 114, in the preferred embodiment, is established as a contoured region including a through point, upon the first side of the top outfit shroud 102. The configuration of the adapter receiver 114 may vary as contemplated by one of ordinary skill in the art. The first side may also include one or more indication areas as described above. A second side of the top outfit shroud may also include one or more indication areas, the adapter receiver, and other features as may be contemplated by those of ordinary skill.

Figure 2:
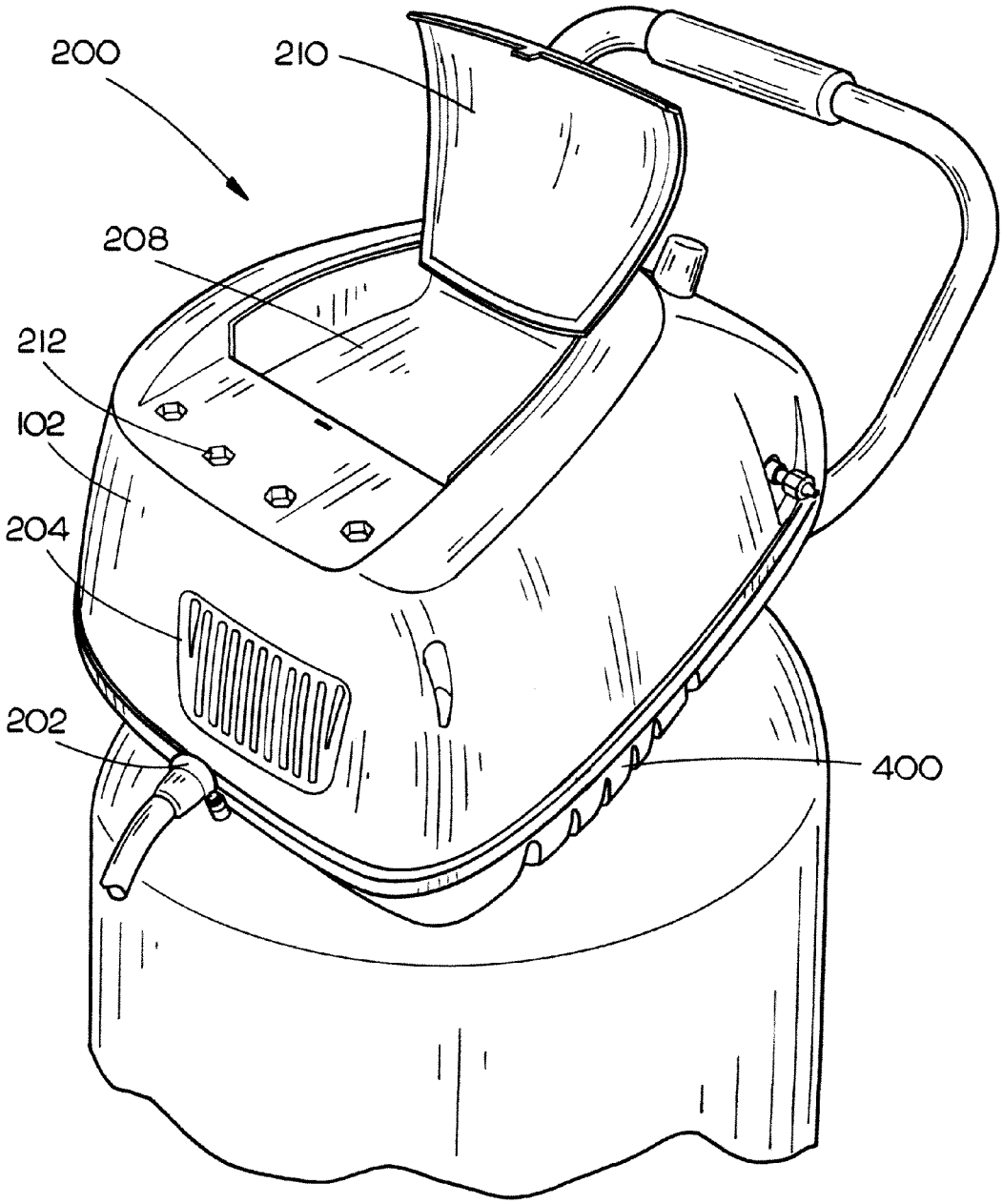
FIG. 2 is a rear view illustration of an air compressor including a shroud assembly in accordance with an exemplary embodiment of the present invention.

FIG. 2 is a rear view illustration of an air compressor including a shroud assembly 200 in accordance with an exemplary embodiment of the present invention. On a back side of the top outfit shroud 102, a power cord receiver 202 and vent 204 are disposed. The power cord receiver 202 is generally disposed in an area of the back side of the top outfit shroud 102 which enables its operational engagement with the bottom outfit shroud 400 (described below). Alternatively, the power cord receiver 202 may be disposed in various locations upon the back side of the top outfit shroud or in various locations upon the top outfit shroud. The vent 204 is generally located on the back side of the top outfit shroud in proximal location to a pump head (described below) of the pump assembly. The vent 204 comprises a region of the back side of the top outfit shroud with a plurality of slotted openings which allow for air to flow between an exterior environment and the interior of the top outfit shroud. The configuration and location of the vent, including the slotted openings, may vary as contemplated by those of ordinary skill. It is further contemplated that the back side of the top outfit shroud may also include one or more indication areas and other features as described previously.

The top outfit shroud 102 further comprises a top side including a storage assembly, as shown in FIG. 2. In the preferred embodiment, the storage assembly comprises a recessed area 208 operationally engaged by a lid 210. The lid 210 couples to the top side through a hinged fastening assembly and is sized to at least partially cover the recessed area 208 of the top side. It is understood that the recessed area 208 may be configured in a variety of sizes. For example, the depth of the recessed area 208 may be varied as well as the length and width. The recessed area 208 may further include features, such as accessory holders 212. For instance, various nozzles which may be employed with an air transfer device, such as an air hose, which couples with the air compressor, may be stored in the accessory holders 212 of the recessed area 208 of the top side. The number, location, and configuration of the accessory holders 212 may vary as contemplated by those of ordinary skill in the art. In alternative embodiments, the recessed area 208 may further provide storage for items such as an air hose.

Figure 3:
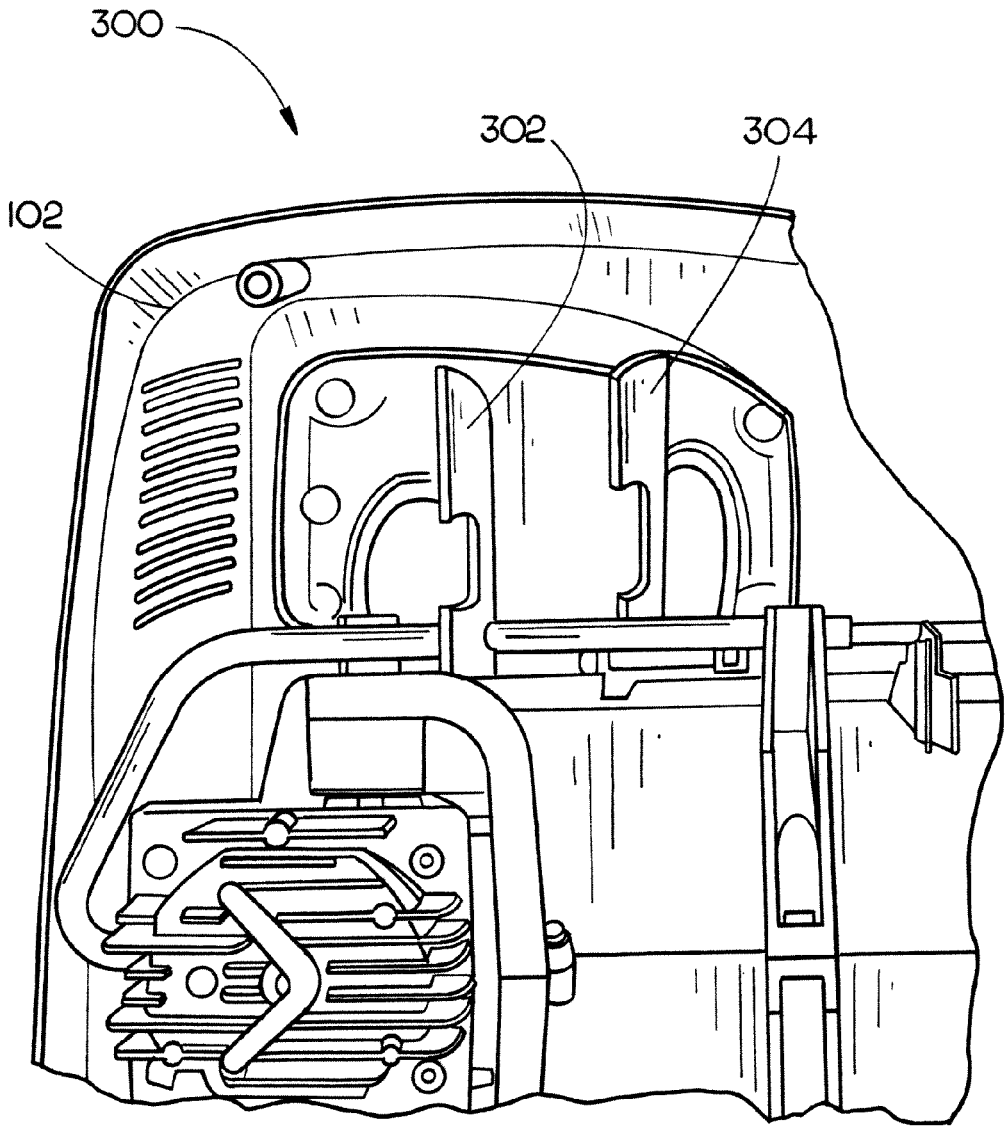
FIG. 3 is a perspective view illustrating a first and a second baffle disposed on the interior of a top outfit shroud of the present invention.

The interior of the top outfit shroud, as shown in FIG. 3, includes a baffling assembly 300. In this preferred embodiment, the baffling assembly 300 includes a first baffle 302 and a second baffle 304 disposed on the interior of the top side of the top outfit shroud 102. The first and second baffles provide the top outfit shroud with the functional capability to duct air flow, within the interior of the outfit shroud, in a particular direction. In the current embodiment, the first and second baffles 302 and 304 prevent exhaust from re-circulating within the outfit shroud. The baffling assembly 300, by preventing re-circulation of exhaust, assists temperature regulation of the pump assembly within the outfit shroud. In particular, the baffle assembly 300 helps to cool the interior of the outfit shroud, and thus the pump assembly, by preventing the exhaust, which is typically hot, from re-circulating. The number of baffles employed within the baffling assembly 300 may vary to accommodate various shroud assemblies. Further, as will be described below, the first and second baffles 302 and 304 may be operationally aligned with the pump shroud.

Figure 4:
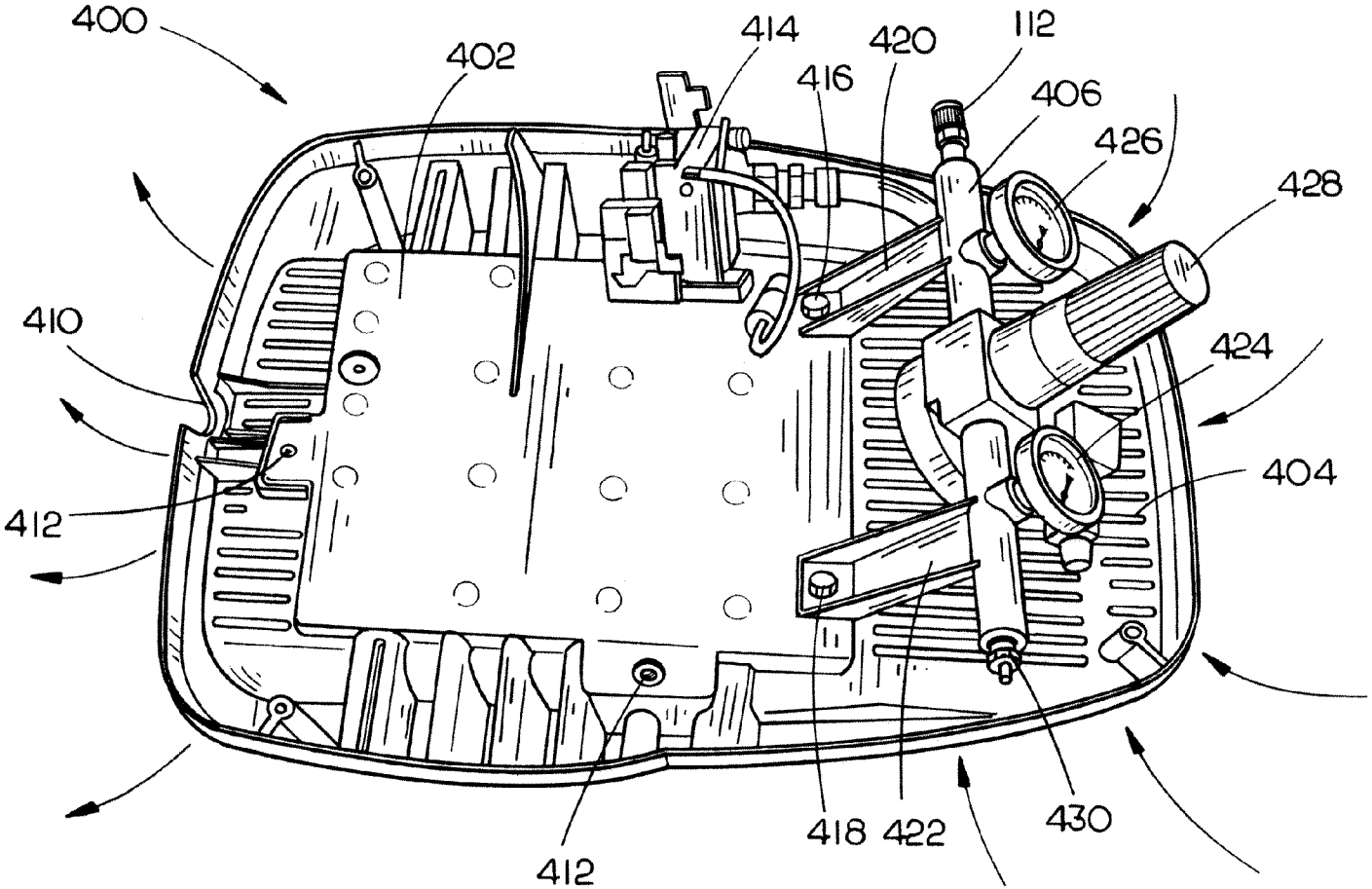
FIG. 4 is an illustration of the bottom outfit shroud coupled with an air tank.
Figure 5:
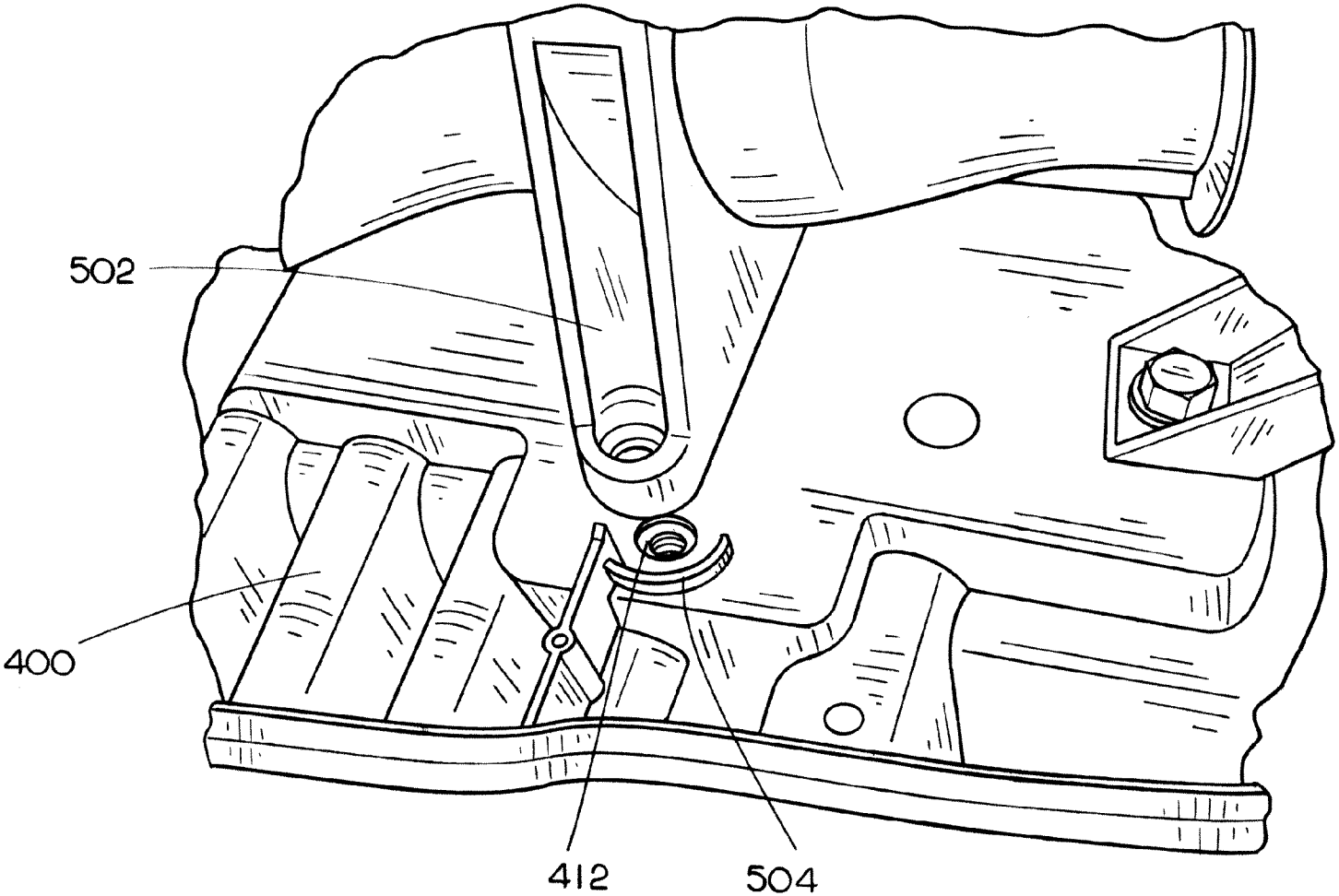
FIG. 5 is an illustration of a tank mounting assembly of the bottom outfit shroud of the present invention.

FIG. 4 is an illustration of the bottom outfit shroud 400 coupled with an air tank. The bottom outfit shroud includes a front, a back, a right, and a left side. Further, disposed within the bottom outfit shroud and between the sides is a mounting plate 402. Disposed within a region of the bottom outfit shroud, proximal to the front side, is an intake venting assembly 404. The intake venting assembly 404 comprises a plurality of slotted openings which allow air to flow from an exterior environment through the bottom outfit shroud 400 and into the interior of the shroud assembly. Extending substantially from the front side to the mounting plate 402, disposed within the bottom outfit shroud 400, and from the right to the left side, the intake venting assembly 404 provides a significant area through which air may be drawn. As is seen in FIG. 4, a manifold assembly 406 (described in greater detail below) provides for the mounting of functional features in a position over the plurality of slotted openings of the intake venting assembly 404. Thus, the positioning of the intake venting assembly 404 draws air up and over the functional features of the manifold assembly 406 assisting in temperature regulation of those features, specifically assisting in keeping these features cool. Air drawn in through the intake venting assembly 404, flows in the direction indicated by the arrows on FIG. 4 and is vented out from the interior of the shroud assembly through the exhaust venting assembly 408.

The exhaust venting assembly 408 comprises a plurality of slotted openings which allow air to flow from the interior of the shroud assembly through the bottom outfit shroud 400 and out into the exterior environment. Extending substantially from the back side to the mounting plate 402 and from the right to the left side, the exhaust venting assembly 408 provides a significant area through which air may be passed. It is understood that the plurality of slotted openings of the intake venting assembly 404 and the exhaust venting assembly 408 may be variously configured. For example, the size and number of the slotted openings may be varied as well as the location of the slotted openings. An advantage of the location of the intake and exhaust venting assemblies 404 and 408, of the present invention, is that by drawing and exhausting air through the bottom outfit shroud 400, these assemblies provide a sound dampening functionality to the air compressor. Further, the bottom venting reduces environmental factors, such as water, dirt, and the like from entering the pump assembly. Additionally, disposed upon the back side of the bottom outfit shroud 400 is a power cord receiver 410. The power cord receiver of the back side 410 of the bottom outfit shroud is positioned for optimal engagement with the power cord receiver 202 of the top outfit shroud 102 (described previously). It is further contemplated that the bottom outfit shroud 400 may not include a power cord receiver or may be disposed with an entire power cord receiving assembly and the top outfit shroud may not include the power cord receiver.

The bottom outfit shroud 400, of the current embodiment, mounts upon the air tank of the air compressor. This mounting is enabled by a plurality of tank mounting assemblies 412 disposed on the mounting plate 402 of the bottom outfit shroud 400 in locations which allow fasteners to couple through the plurality of tank mounting assemblies 412 of the bottom outfit shroud with a plurality of couplers of the air tank. It is understood that the location, configuration, and number of tank mounting assemblies 412 may vary to accommodate the location, configuration, and number of air tank couplers. Further, as may be seen in FIG. 5, a pump shroud boss assembly 502, for coupling the pump shroud with the air tank and placing the pump shroud in operational engagement with the bottom outfit shroud 400, may be engaged by a fastener enabled to extend through the pump shroud boss assembly 502 and the tank mounting assembly 412 and engage within the air tank coupler. Thus, the plurality of tank mounting assemblies 412 provide an alignment system which ensures the proper mounting position of the bottom outfit shroud 400 and the pump shroud relative to the air tank of the air compressor.

It is contemplated that the plurality of tank mounting assemblies 412 may be disposed other than on the mounting plate 402, instead in close proximity to the mounting plate. Further, the fasteners employed for mounting of the bottom outfit shroud 400 and pump shroud boss assembly 502 with the air tank may vary, such as screws, bolts, pins, clips, and the like, without departing from the scope and spirit of the present invention. It is further contemplated that the plurality of tank mounting assemblies 412 may each include a receiver 504 for engagement with the pump shroud boss assembly 502. In the current embodiment, the receiver 504 is a semi-circular raised lip. In alternative embodiments, the receiver may be a square shaped raised lip, and the like, or may be a flat side, and the like, to provide operational engagement with the pump shroud boss assembly 502.

The mounting plate 402 of the bottom outfit shroud 400 provides a region, disposed substantially between the intake venting assembly 404 and the exhaust venting assembly 408, and the right and left side of the bottom outfit shroud, configured for operational engagement with the pump shroud. It is noted that the pump orientation, provided by the engagement of the pump shroud with the mounting plate 402, pulls cool air across gauges and a regulator of the manifold assembly 406 and expels hot air from a back side of the shroud assembly 200. In the preferred embodiment, the mounting plate 402 is a substantially planar surface area, however, it is understood that the mounting plate 402 may provide variously configured surface areas for engagement with variously configured pump shrouds or other assemblies. Coupled proximal to the intersection of a front edge and right side of the mounting plate is the pressure switch assembly 414 (described below). Disposed within the front edge and proximal to a left side is a first manifold receiver 416, proximal to the right side is a second manifold receiver 418. These receivers at least partially encompass first and second manifold couplers, disposed on the air tank, which are configured to be engaged by a first regulator leg 420 and a second regulator leg 422 of the manifold assembly 406. The first and second regulator legs 420 and 422 engage with the first and second manifold couplers through the use of fasteners, such as screws, bolts, pins, clips, and the like. As seen in FIG. 4, the mounting plate 402 includes first and second tank mounting assemblies 412 disposed on the left side and a back edge of the mounting plate 402 respectively. It is understood that other tank mounting assemblies may be disposed on the mounting plate. Further, it is understood that the mounting plate may include no tank mounting assemblies.

Figure 6:
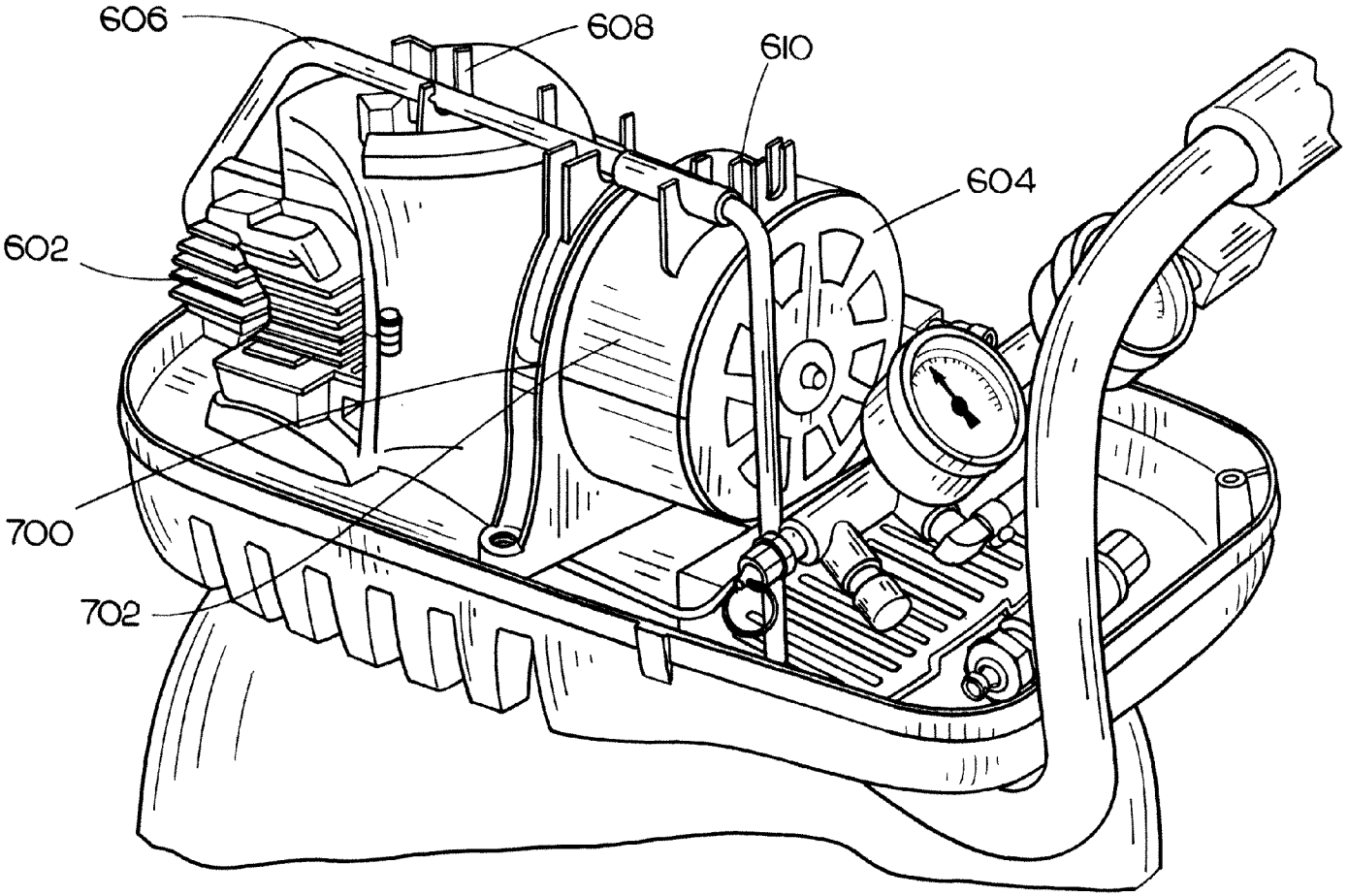
FIG. 6 is an illustration of a pump shroud including an outlet tubing rib assembly.
Figure 7:
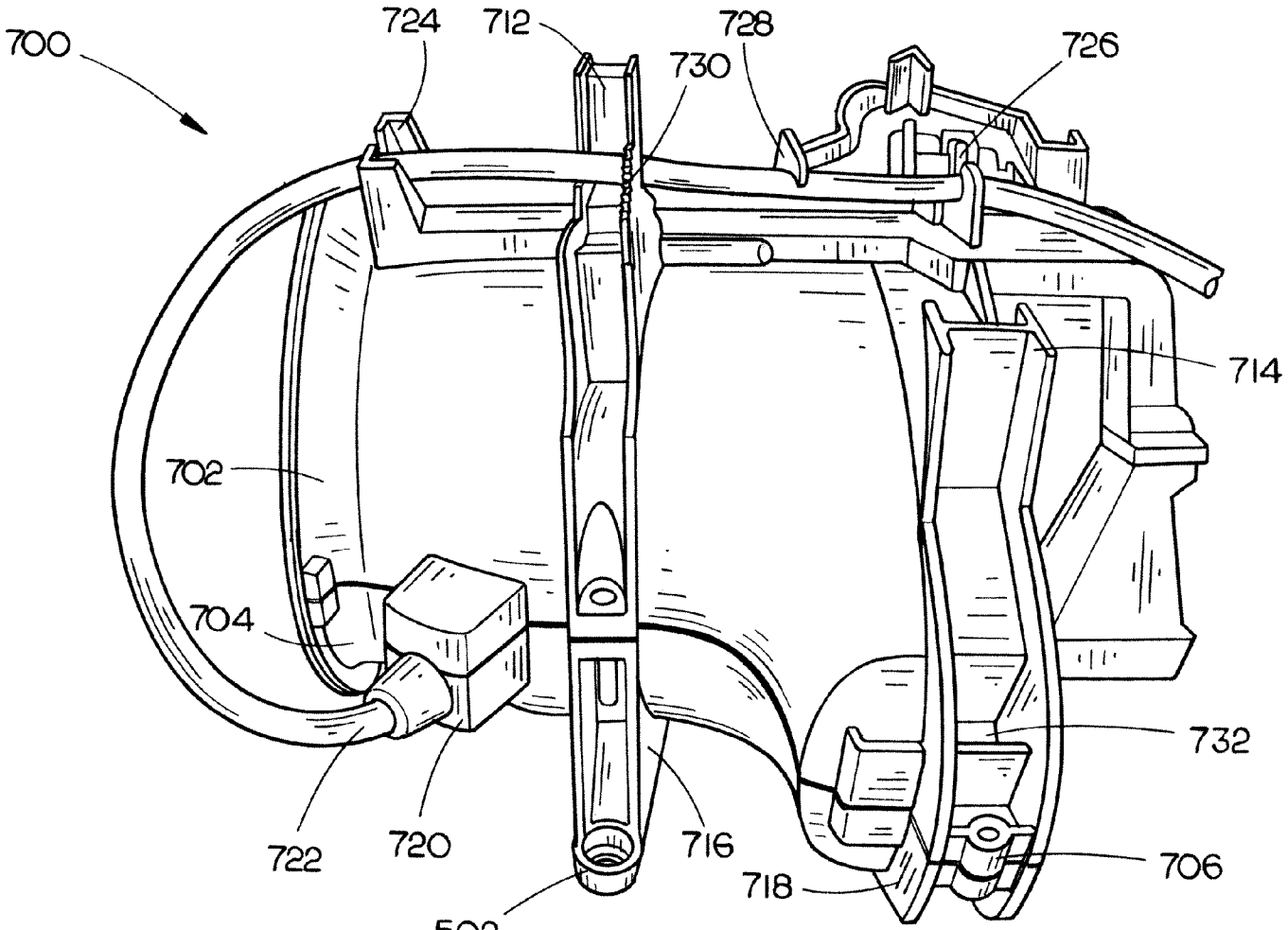
FIG. 7 is an illustration of the pump shroud including a strain relief assembly.
Figure 12B:
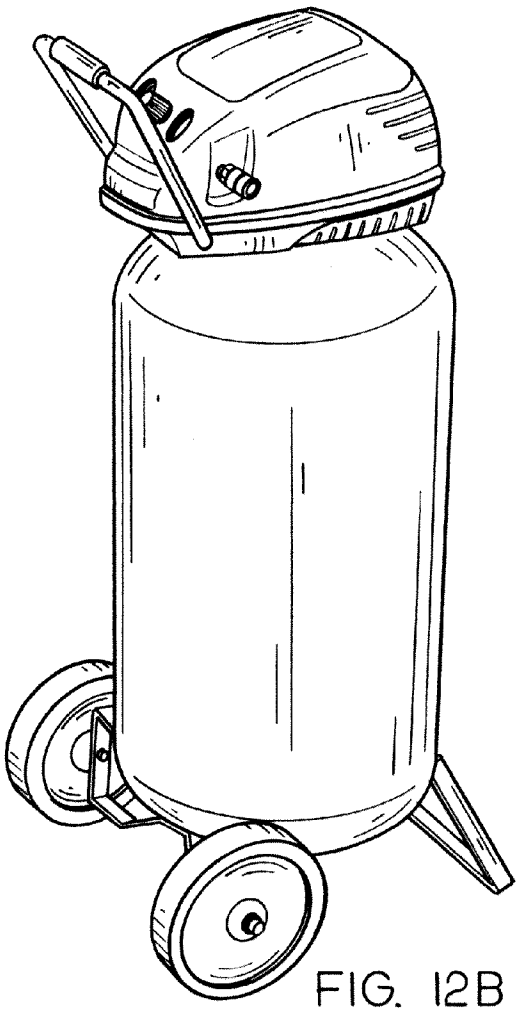
FIGS. 12A and 12B are illustrations exemplifying various configurations of a shroud assembly of an air compressor assembly contemplated by the present invention.
Figure 12A:
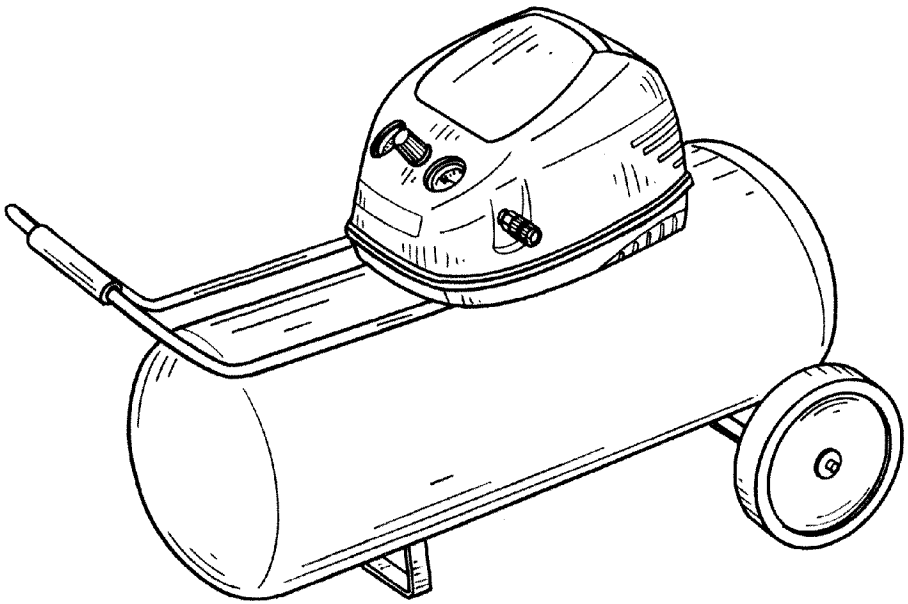

FIGS. 6 and 7 are illustrations of a pump shroud. The pump shroud 700 is comprised of a top pump shroud 702 and a bottom pump shroud 704. The pump shroud at least partially encompasses the pump assembly, with a pump head 602 of the pump assembly, shown extending from a left side of the pump shroud, in FIG. 6. The configuration of the pump shroud 700 may be varied to accommodate differently designed pump assemblies. An advantage of the pump shroud is that it allows for the reconfiguration of the outfit shroud as shown in FIGS. 12A and 12B. Other configurations, than those shown, of the outfit shroud may be enabled by use of the pump shroud 700 of the present invention.

The top pump shroud 702 and the bottom pump shroud 704 are coupled together via a plurality of coupling assemblies 706. The coupling assemblies 706 provide receivers configured to receive fasteners, such as screws, bolts, pins, clips, and the like, for fastening the two components together. The location of the coupling assemblies 706 may vary to accommodate different design configurations. When joined together, as shown in the perspective view provided by FIG. 7, the pump shroud 700 has a top side, a bottom side, a right side, and a left side. The left side is where the pump head 602 extends out from the pump shroud 700. The right side is where a fan 604 of the pump assembly is located. The fan draws air in through the intake venting assembly 404 disposed on the bottom outfit shroud 400 described above.

The top pump shroud 702 and the bottom pump shroud 704 include first and second stacking rib assemblies respectively. The stacking rib assemblies comprise a plurality of stacking ribs disposed upon the exterior of the pump shroud which form a flat surface to allow for the stacking of the exemplary pump shrouds for shipment. This may be a significant advantage in reducing damage done to the pump shrouds during shipment. The number and location of the stacking ribs may vary as contemplated by one of ordinary skill in the art. In the preferred embodiment, the first stacking rib assembly of the top pump shroud includes a first stacking rib 712 and a second stacking rib 714 while the second stacking rib assembly of the bottom pump shroud includes a first bottom stacking rib 716 and a second bottom stacking rib 718. It is understood that the configuration of the stacking ribs may vary to accommodate the design of the pump shroud. In the preferred embodiment, the coupling assemblies 706 for coupling the top pump shroud with the bottom pump shroud are disposed in general relation to the stacking rib assemblies. It is further contemplated that the baffles 302 and 304 disposed internally upon the top outfit shroud 102 may or may not align with the stacking rib assemblies of the pump shroud.

The pump shroud 700 forms a generally cylindrical shape and may be mounted to the air tank through a plurality of pump shroud boss assemblies 502. As described previously, the pump shroud boss assemblies 502 allow for the engagement of a fastener through them and engage with the air tank, thereby affixing the location of the pump shroud relative to the air tank. The pump shroud 700 has the effect of mounting the pump assembly disposed within the pump shroud directly with the air tank. This is an advantageous mounting arrangement as the direct mounting of the pump assembly may help reduce vibration from the pump assembly during operation. Mounting the pump shroud 700 only to the bottom outfit shroud 400 may result in increased vibration of the pump assembly during operation.

In the exemplary embodiment shown, the pump shroud 700 further comprises a strain relief assembly incorporated into the pump shroud. This is advantageous over the prior art in the field which typically incorporates the strain relief assembly onto an outer shroud (or outfit shroud in the present invention terminology). The strain relief assembly comprises a strain relief 720 which is integrated into the top and bottom pump shrouds 702 and 704 of the present embodiment. It is contemplated that the strain relief 720 may be incorporated solely into either the top or bottom shroud. The strain relief 720 couples a cord assembly 722 of the pump assembly in a manner designed to reduce the amount of strain placed on the cord assembly. In the embodiment shown, the strain relief 720 is disposed proximally to the bottom side and left side of the pump shroud 700.

The cord assembly 722 is shown to wrap, at least partially, around the pump shroud 700 and is engaged with a strain relief rib assembly of the strain relief assembly. The strain relief rib assembly provides several features, all of which are designed to help ensure that the cord assembly 722 is securely affixed along the length of the pump shroud 700 and does not come loose during operation of the air compressor. A loose cord assembly may cause damage to the pump assembly or other components of the air compressor. The strain relief rib assembly includes first and second "U" shaped ribs 724 and 726, disposed on a left edge of the top side of the pump shroud 700 and a right edge of the top side of the pump shroud 700, respectively. The "U" shaped ribs 724 and 726 are preferably employed to hold the position of the cord assembly 722 for the pump assembly. Further, an upside down "J" shaped rib 728 is disposed between the first and second "U" shaped ribs 724 and 726. The upside down "J" shaped rib 728 engages with the cord assembly 722 to keep the cord assembly from bowing out of position and possibly causing damage. In the present embodiment, the strain relief assembly also includes a comb feature 730, which is utilized to fix and hold the position of multiple cords in situations where multiple cords are required. The multiple cords may still engage with the "U" and "J" shaped ribs while also being operationally engaged by the comb feature 730.

An outlet tubing 606 of the pump assembly, is shown engaged in an outlet tubing rib assembly disposed upon the top pump shroud 702 of the pump shroud 700 in FIG. 6. In the preferred embodiment, the outlet tubing rib assembly comprises first and a second "U" shaped outlet tubing ribs 608 and 610. It is understood that the number of "U" shaped ribs may vary as contemplated by one of ordinary skill. The ribs 608 and 610 fix the location of the outlet tubing 606 relative to the pump shroud 700. The two "U" shaped ribs 608 and 610 of the present invention are operationally engaged with first and second snap assemblies. The first and second snap assemblies provide a compression lock system for holding the outlet tubing 606 in place. Thus, the outlet tubing "snaps" into the correct position when the two snap assemblies have locked into place.

Figure 10:
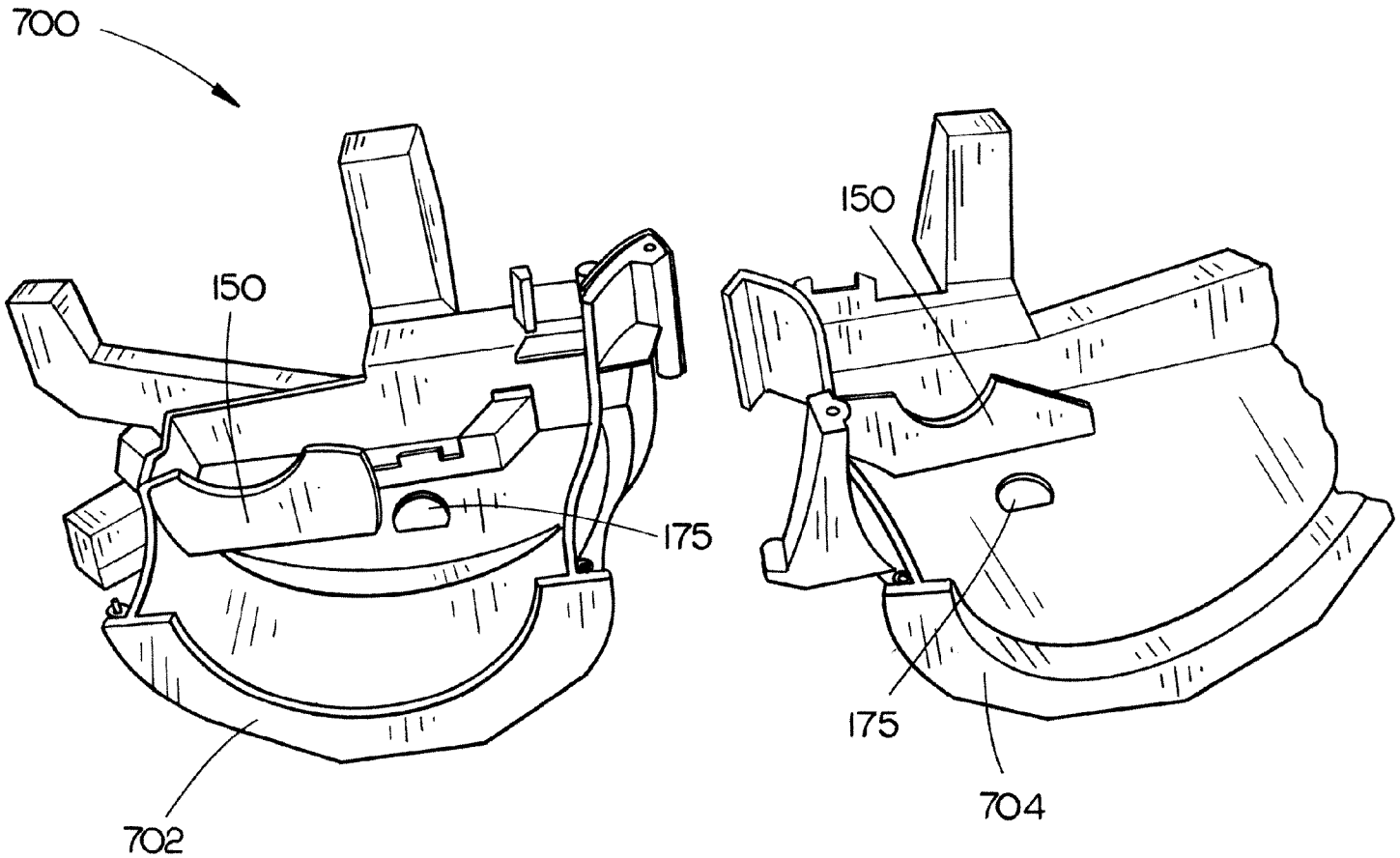
FIG. 10 is an illustration of the top pump shroud and the bottom pump shroud of the pump shroud in accordance with an exemplary embodiment of the present invention.

FIG. 10 is an interior view of the top pump shroud 702 and the bottom pump shroud 704 of the pump shroud in accordance with an exemplary embodiment of the present invention. Internally, the pump shroud 700 includes an internal pump shroud baffling assembly comprising a plurality of baffles 150. Thus, the pump shroud directs air flow along the motor and pump heads of the pump assembly. The plurality of baffles 150 may optimally be disposed proximal to the pump head, however, alternative embodiments are contemplated with the baffles 150 variously located about the pump shroud 700. The baffles 150 channel cool air across and through the motor windings to assist in keeping the pump head cool. The pump assembly includes a filter boss assembly. The filter boss assembly may cover and operationally engage with an air filter, disposed proximally to the pump head for the air entering the pump. In operation, the filter boss assembly keeps the air moving across the pump head. It is contemplated that the air filter may be an inertial filter.

Figure 8:
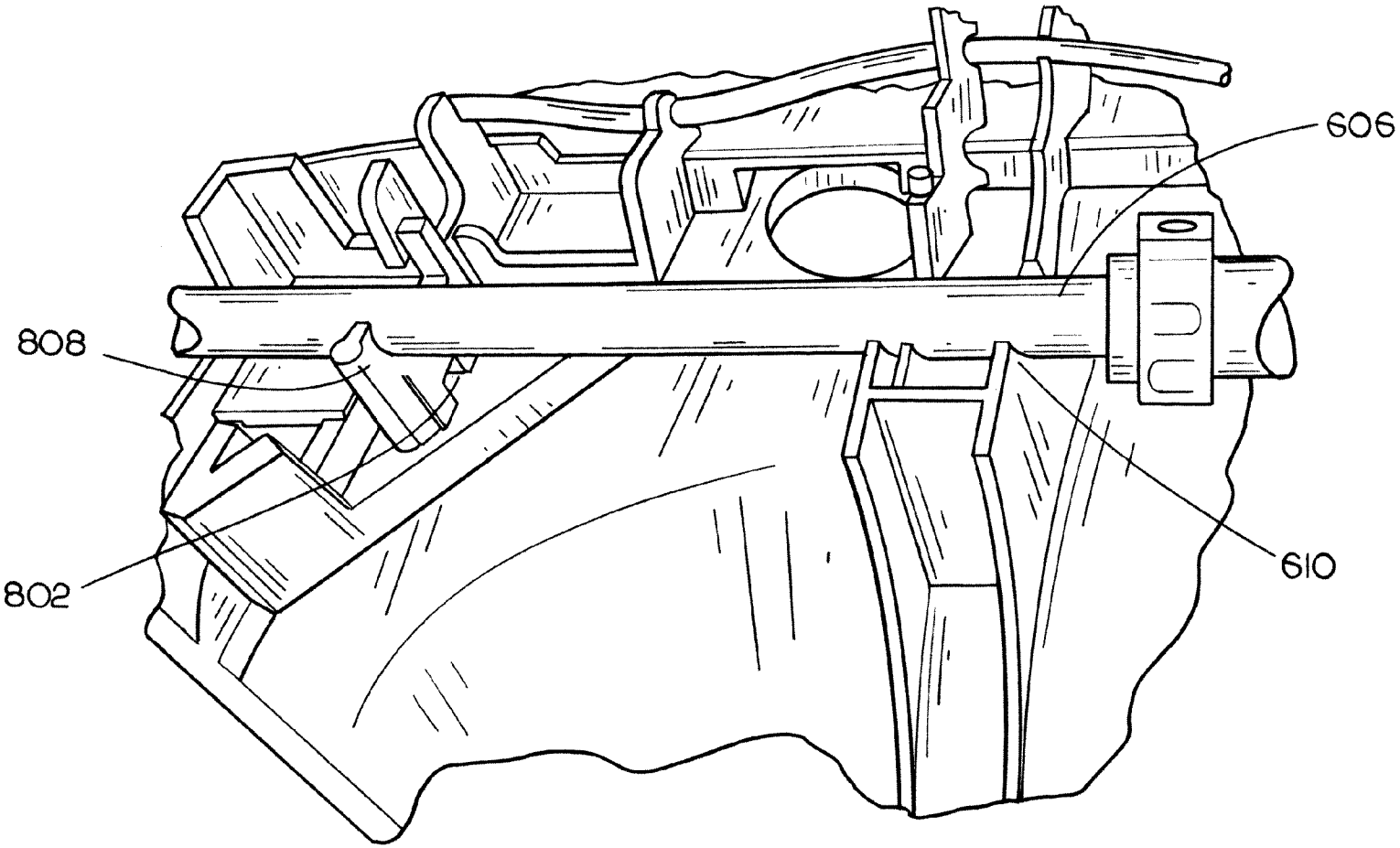
FIG. 8 is an illustration of the outlet tubing rib assembly and a vent disposed proximal to a "U" shaped rib of the outlet tubing rib assembly.

FIG. 8 is an illustration of the outlet tubing rib assembly and a vent disposed proximal to a "U" shaped rib of the outlet tubing rib assembly. Disposed upon the top and bottom pump shrouds are a plurality of vents 802, which are rectangular slotted apertures, for cooling of the outlet tube 606 and visual identification within the pump shroud 700. The location of the vents 802 may vary to accommodate the needs of the configuration of the pump assembly. In the current embodiment, first and second vents 802 are located proximally to the first and second "U" shaped outlet tubing ribs 608 and 610. The first and second vents 802 operationally engage with the first and second snap assemblies. The first and second snap assemblies being affixed at one end within the interior of the pump shroud 700 proximal to the first and second vents 802.

Figure 9:
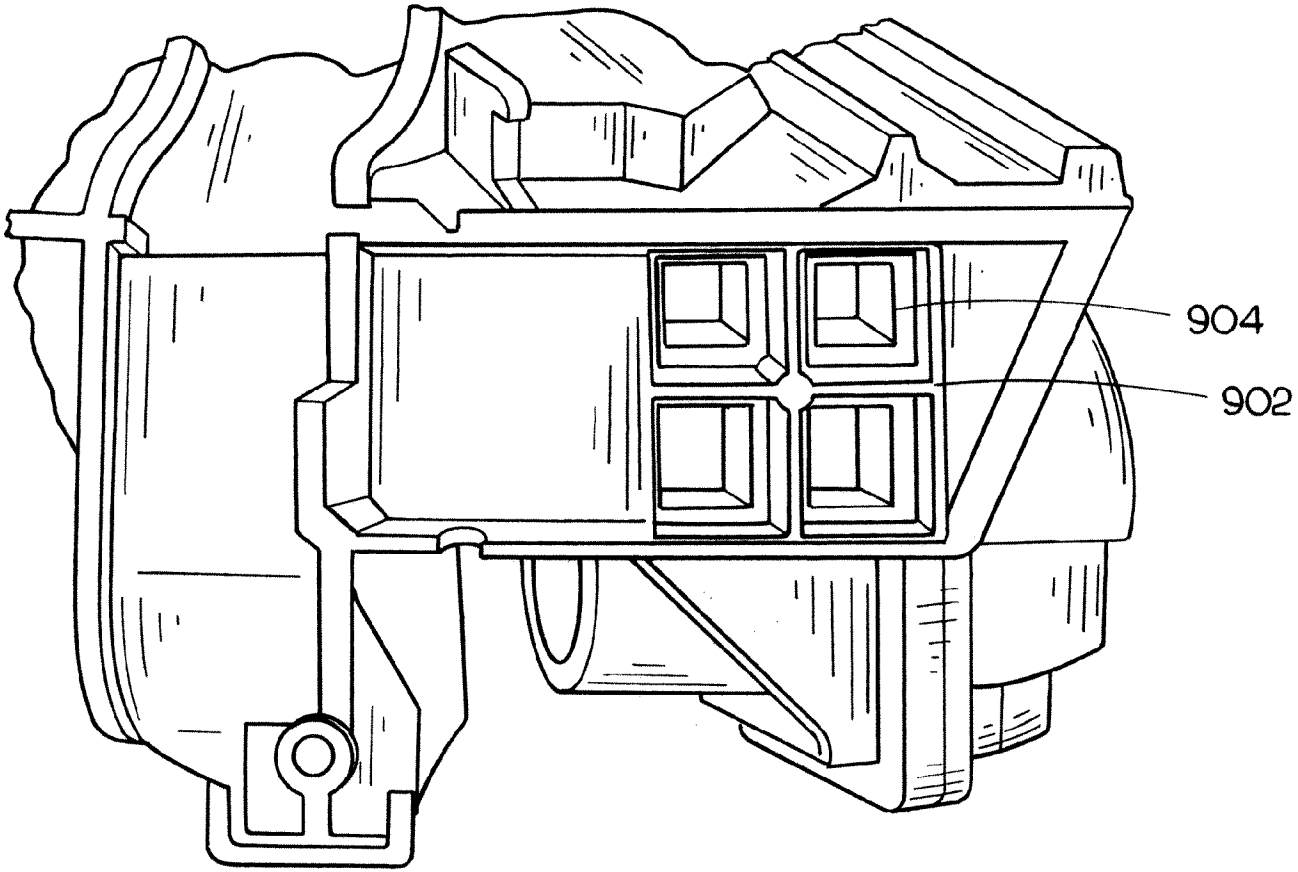
FIG. 9 is an illustration of a window providing a view of an isolator used in the mounting of the pump assembly within the pump shroud.

Referring to FIGS. 7, 9 and 10 disposed in a plurality of locations upon the pump shroud 700 are a plurality of windows. These windows allow for an operator to visually inspect the interior of the pump shroud 700. In the preferred embodiment, a first set of rectangular windows 902, shown in FIG. 9, is located beneath the pump head. This first set 902 comprises four separate rectangular windows proximal to each other. A second set of windows 175, illustrated in FIG. 10, is disposed on the top and bottom pump shroud 702 and 704, being generally positioned opposite of one another. The second set of windows 175, includes a first circular window disposed on the top side of the top pump shroud and a second circular window disposed on the bottom side of the bottom pump shroud. The third set of windows 732, illustrated in FIG. 7, comprise rectangular windows disposed proximally to the coupling assemblies 706 which provide for the coupling of the top and bottom pump shroud 702 and 704.

Referring to FIG. 9, the pump assembly is mounted inside the pump shroud 700 with isolators 904. In a preferred embodiment, the isolators 904 are rectangular, rubber mounts which mount over an intake boss of the pump assembly. One of the functions of the aforementioned first set of windows 902 is to allow assemblers of the present invention to see the isolators 904 when assembling the present invention. This may reduce the number of mis-assembled air compressors, of the present invention, coming from production and assembly facilities.

Figure 11:
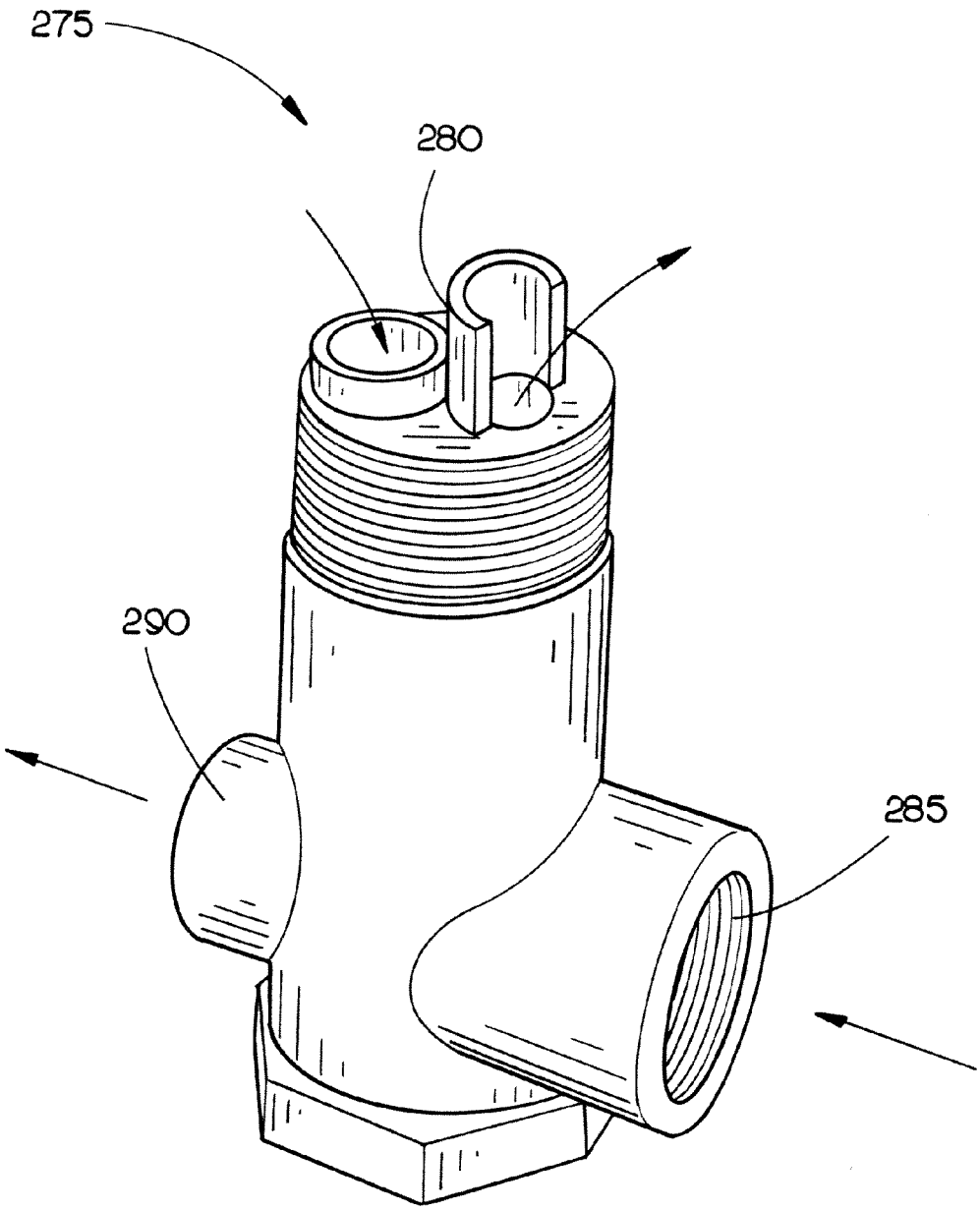
FIG. 11 is an illustration of a standpipe of the present invention.

Referring to FIG. 11, the pump assembly includes a standpipe 275, for directing air inlet to an air tank and outlet to a regulator through a same port in the tank. An advantage of the standpipe 275 of the present invention is the inclusion of a protective lip assembly 280 disposed on the end of the standpipe 275 that is within the air tank for operation. The lip assembly 280 prevents the quick turn of air from inlet 285 to outlet 290. It is commonly the case, with typical air compressor assemblies, that the air tank must comprise multiple ports and an inlet port must be physically separated from the outlet port in order to prevent the quick turn of air from inlet to outlet. With the standpipe 275 of the present invention, the air tank may use only one port to accomplish both air intake and exhaust.

Referring to FIG. 4, the manifold assembly 406 comprises a manifold which uses specific casting to control the location and angle of presentation of the regulator and gauges. The manifold, via first and second regulator legs 420 and 422 is bolted to the air tank, independent of the pump assembly, to reduce vibration. The manifold assembly 406 includes an adapter assembly 112 providing for the functional coupling of an air transfer device, such as an air hose, with the air compressor. In the preferred embodiment, the adapter assembly 112 includes a quick connect for coupling with an air hose. It is contemplated that the adapter assembly 112 may comprise a variety of fastening assemblies, such as a threaded fastener, a compression fastener, and the like, without departing from the scope and spirit of the present invention. In the current embodiment, the adapter assembly extends from a right side of the manifold assembly 406 out through the outfit shroud for engagement by the operator of the air compressor. In the preferred embodiment, the manifold assembly 406 further includes first and second gauges 424 and 426 respectively. The two gauges may be configured to monitor and provide readings on air tank pressure and exhaust pressure. It is contemplated that the gauges 424 and 426 may provide a variety of readouts, such as needle, digital readouts, plasma readouts, and the like. Further included on the manifold assembly 406 is an adjustment knob 428 for adjusting pressures provided by the air compressor. This adjustment mechanism may be enabled in alternative embodiments as a depression switch, digital controller, and the like. A bleed off valve assembly 430 is also disposed on the manifold assembly 406 and extends through the second side of the outfit shroud.

Referring to FIG. 1, an on/off switch 116 is mounted within the first face of the top outfit shroud 102 and operationally couples with the pressure switch assembly 414. The on/off switch 116 is located remotely from a pressure switch of the pressure switch assembly 414. The ability to remotely locate the on/off switch provides greater flexibility and may increase the ease of use of the air compressor of the present invention. It is contemplated that the on/off switch 116 may be lighted to show when a circuit providing electricity to the pressure switch 414 is complete. For example, when the on/off switch 116 is lit the operator knows that the pressure switch 414 is monitoring the pressure within the air tank so that when the pressure passes a threshold value the pressure switch 414 will activate or de-activate the pump as indicated by the threshold value. In operation, the air compressor may have 150 PSI of air within the air tank and through use of the air compressor that may drop to 115 PSI. The pressure switch 414 may have a threshold value of 125 PSI, whereupon the pressure switch activates the pump assembly when pressure within the air tank drops below 125 PSI. When the on/off switch 116 is not lit, the operator knows that the pressure switch 414 is not monitoring the air pressure within the tank, thus, by the present example, the air pressure would continue to drop below the 125 PSI value, without the pump assembly being activated to increase the pressure. It is further contemplated that the on/off switch 116 may include a protective covering, such as a plastic boot for extreme environment operation. The on off switch 116 may be enabled as a two-position switch, however, it is contemplated that a variety of switch assemblies may be employed with the present invention.

The handle assembly 118 is coupled with the air tank and operationally engaged by the bottom outfit shroud 400. In the preferred embodiment, the handle 118 is a "U" shaped handle which extends from the air tank and angles in front of the front face of the top outfit shroud 102. The handle 118 is composed of a rigid material, for example metal, plastic, composite, or other rigid material. The configuration of the handle 118 may vary as contemplated by one of ordinary skill in the art. It is further contemplated that the handle assembly 118 may include a wrap assembly coupled with a gripping region of the handle assembly. The wrap assembly may comprise a material which provides a comfortable grip, such as rubber, foam, and the like. The wrap assembly may encompass all or part of the gripping region without departing from the scope and spirit of the present invention.

Various configurations of the shroud assembly, pump assembly, air tank assembly, and handle assembly are shown in FIGS. 12A and 12B. It is understood that these embodiments are exemplary and not limiting of the embodiments contemplated for the present invention. Further, the design and configuration of the pump assembly, pressure switch assembly, and manifold assembly which have been shown and described are exemplary for the purposes of the present embodiments and they too should not be read as limiting of the configurations contemplated by the present invention.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof.

What is claimed is:

1. A shroud assembly, comprising:

an outfit shroud including a top outfit shroud coupled with a bottom outfit shroud; and, a pump shroud including a top pump shroud coupled with a bottom pump shroud;

wherein the pump shroud at least partially encompasses a pump assembly of an air compressor and the outfit shroud at least partially encompasses the pump assembly, the pump shroud, a manifold assembly and a pressure switch assembly of the air compressor, the shroud assembly further configured for mounting to an air tank of the air compressor, the shroud assembly allowing for access to working parts of the air compressor and also allowing for a cooling air flow through the interior of the outfit shroud, wherein the bottom outfit shroud includes an intake venting assembly allowing for the entry of air into the interior of the shroud assembly and an exhaust venting assembly allowing for the outlet of air from the interior of the shroud assembly, and wherein the manifold assembly is mounted over the intake venting assembly to receive air drawn therethrough.

2. A shroud assembly as claimed in claim 1, wherein a first face of the top outfit shroud includes one or more gauge receivers, a switch receiver, and an adjustment knob receiver.

3. A shroud assembly as claimed in claim 1, wherein a first side of the top outfit shroud includes an adapter receiver.

4. A shroud assembly as claimed in claim 3, wherein a second side of the top outfit shroud includes a bleed-off valve receiver.

5. A shroud assembly as claimed in claim 1, wherein a back side of the top outfit shroud includes a power cord receiver and a vent, the vent allowing for air flow between an exterior environment and the interior of the top outfit shroud.

6. A shroud assembly as claimed in claim 1, wherein a top side of the top outfit shroud includes a storage assembly, the storage assembly having a recessed area operationally engaged by a lid, the lid coupled to the top side of the top outfit shroud and sized to at least partially cover the recessed area, the recessed area including a plurality of accessory holders.

7. A shroud assembly as claimed in claim 1, wherein the interior of the top outfit shroud includes a baffling assembly, the baffling assembly having a plurality of baffles disposed on the interior of the top side of the top outfit shroud for assisting in cooling the interior of the outfit shroud.

8. A shroud assembly as claimed in claim 1, wherein disposed within the bottom outfit shroud is a mounting plate, the mounting plate having a plurality of tank mounting assemblies disposed on its surface, the tank mounting assemblies configured for assisting in mounting the bottom outfit shroud and the pump shroud to an air tank of the air compressor.

9. A shroud assembly as claimed in claim 1, wherein the top pump shroud and bottom pump shroud are coupled via a plurality of coupling assemblies.

10. A shroud assembly as claimed in claim 1, wherein the top pump shroud and bottom pump shroud each have disposed upon their respective exterior surfaces a stacking rib assembly.

11. A shroud assembly as claimed in claim 1, wherein the pump shroud includes a plurality of pump shroud boss assemblies for operationally engaging the pump shroud with the bottom outfit shroud and assisting in coupling the pump shroud to the air tank of the air compressor via the bottom outfit shroud.

12. A shroud assembly as claimed in claim 1, wherein the pump shroud includes a strain relief assembly having a strain relief for coupling a cord assembly of the pump assembly.

13. A shroud assembly as claimed in claim 1, wherein the pump shroud includes a strain relief rib assembly configured for securing a cord assembly of the pump assembly.

14. A shroud assembly as claimed in claim 1, wherein the pump shroud includes an outlet tubing rib assembly for securing an outlet tubing of the pump assembly.

15. A shroud assembly as claimed in claim 1, wherein the interior of the pump shroud includes an internal pump shroud baffling assembly having a plurality of baffles for assisting in cooling the pump assembly.

16. A shroud assembly as claimed in claim 1, wherein the pump shroud includes a plurality of vents.

17. A shroud assembly as claimed in claim 1, wherein the pump shroud includes a plurality of windows for allowing visual inspection of the interior of the pump shroud.

18. A shroud assembly as claimed in claim 1, wherein the pump shroud includes a plurality of isolators for assisting in mounting the pump assembly within the pump shroud.

19. A shroud assembly as claimed in claim 1, wherein a handle assembly coupled with an air tank of the air compressor is operationally engaged with the bottom outfit shroud.

20. A shroud assembly, comprising:

an outfit shroud including a top outfit shroud coupled with a bottom outfit shroud, the top outfit shroud including one or more gauge receivers, a switch receiver, an adjustment knob receiver, an adapter receiver, a bleed-off valve receiver, a power cord receiver, a vent, a storage assembly and a baffling assembly, the bottom outfit shroud including a mounting plate, the mounting plate having a plurality of tank mounting assemblies, the bottom outfit shroud further including an intake venting assembly and an exhaust venting assembly; and, a pump shroud including a top pump shroud coupled with a bottom pump shroud via a plurality of coupling assemblies, the pump shroud including a plurality of stacking assemblies disposed on an exterior surface of the top pump shroud and the bottom pump shroud, a plurality of pump shroud boss assemblies, a strain relief assembly, a strain relief rib assembly, an outlet tubing rib assembly, an internal pump shroud baffling assembly, a plurality of vents, a plurality of windows and a plurality of isolators;

wherein the pump shroud at least partially encompasses a pump assembly of an air compressor and the outfit shroud at least partially encompasses the pump assembly, the pump shroud, a manifold assembly and a pressure switch assembly of the air compressor, the shroud assembly further configured for mounting to an air tank of the air compressor, the shroud assembly allowing for access to working parts of the air compressor and also allowing for a cooling air flow through the interior of the outfit shroud.

21. A shroud assembly as claimed in claim 20, wherein the intake venting assembly of the bottom outfit shroud allows for the entry of air into the interior of the shroud assembly and the exhaust venting assembly of the bottom outfit shroud allows for the outlet of air from the interior of the shroud assembly.

22. A shroud assembly as claimed in claim 20, wherein the baffling assembly of the top outfit shroud includes a plurality of baffles disposed on the interior of the outfit shroud which prevent exhaust generated by the air compressor from recirculating within the outfit shroud, thereby assisting in cooling the outfit shroud.

23. A shroud assembly as claimed in claim 20, wherein the internal pump shroud baffling assembly includes a plurality of baffles disposed on the interior of the pump shroud which direct a cool air flow across and through at least the pump head of the pump assembly, thereby assisting in cooling the pump assembly.

24. A shroud assembly as claimed in claim 20, wherein one or more of the plurality of vents located on the pump shroud are located proximal to the outlet tubing rib assembly.

25. A shroud assembly, comprising:

an outfit shroud including a top outfit shroud coupled with a bottom outfit shroud, the top outfit shroud including one or more gauge receivers, a switch receiver, an adjustment knob receiver, an adapter receiver, a bleed-off valve receiver, a power cord receiver, a vent, a storage assembly and a baffling assembly, the bottom outfit shroud including a mounting plate, the mounting plate having a plurality of tank mounting assemblies, the bottom outfit shroud further including an intake venting assembly and an exhaust venting assembly; and, a pump shroud including a top pump shroud coupled with a bottom pump shroud via a plurality of coupling assemblies, the pump shroud including a plurality of stacking assemblies disposed on an exterior surface of the top pump shroud and the bottom pump shroud, a plurality of pump shroud boss assemblies, a strain relief assembly, a strain relief rib assembly, an outlet tubing rib assembly, an internal pump shroud baffling assembly, a plurality of vents, a plurality of windows and a plurality of isolators;

wherein the intake venting assembly is disposed within the bottom outfit shroud proximal to a front side and the exhaust venting assembly is located within the bottom outfit shroud proximal to a back side of the bottom outfit shroud;

wherein the pump shroud at least partially encompasses a pump assembly of an air compressor and the outfit shroud at least partially encompasses the pump assembly, the pump shroud, a manifold assembly and a pressure switch assembly of the air compressor, the shroud assembly further configured for mounting to an air tank of the air compressor, the shroud assembly allowing for access to working parts of the air compressor and also allowing for a cooling air flow through the interior of the outfit shroud.

26. A shroud assembly as claimed in claim 25 wherein the shroud assembly is configured so that the pump assembly causes cool air to be drawn into the outfit shroud via the intake venting assembly, across the manifold assembly and directed out of the outfit shroud via the exhaust venting assembly.

* * * * *